US007607544B2

(12) United States Patent
Petersen et al.

(10) Patent No.: US 7,607,544 B2
(45) Date of Patent: Oct. 27, 2009

(54) APPARATUS FOR USE TO CHECK POTATOES OR SIMILAR ITEMS

(75) Inventors: Gunnar Petersen, Odense (DK); Anders Petersen, Odense (DK)

(73) Assignee: Newtec Engineering A/S, Odense M (DK)

( * ) Notice: Subject to any disclaimer, the term of this patent is extended or adjusted under 35 U.S.C. 154(b) by 505 days.

(21) Appl. No.: 10/584,701

(22) PCT Filed: Dec. 22, 2004

(86) PCT No.: PCT/DK2004/000898

§ 371 (c)(1),
(2), (4) Date: Jun. 22, 2006

(87) PCT Pub. No.: WO2005/061130

PCT Pub. Date: Jul. 7, 2005

(65) Prior Publication Data

US 2007/0144946 A1 Jun. 28, 2007

(51) Int. Cl.
*B07C 5/00* (2006.01)
*B07C 5/02* (2006.01)
*B07C 5/36* (2006.01)

(52) U.S. Cl. ..... 209/44.1; 209/539; 209/577; 209/618; 209/914

(58) Field of Classification Search ..... 209/44.1, 209/539, 552, 576, 577, 618, 621, 667, 670, 209/673, 678, 914, 922; 198/621.1, 624, 198/446, 608, 611, 782, 817
See application file for complete search history.

(56) References Cited

U.S. PATENT DOCUMENTS 3,224,552 A 12/1965 McNeill (Continued)

FOREIGN PATENT DOCUMENTS

EP 0332477 A1 9/1989

(Continued)

OTHER PUBLICATIONS

International Preliminary Report On Patentability (PCT/IB/373).

(Continued)

*Primary Examiner*—Patrick H Mackey
*Assistant Examiner*—Mark Hageman
(74) *Attorney, Agent, or Firm*—Cooper & Dunham LLP

(57) ABSTRACT

Apparatus for use to check potatoes or similar items, the apparatus including a feeding device for advancing the potatoes in a plurality of rows, a conveying device adapted to receive the rows of potatoes from the feeding device and advancing them while maintaining the row structure, at least one camera with associated image processor for recording and evaluating each individual potato on the conveying device and a sorting device controlled by the image processor, the sorting device being adapted to sort the potatoes. The conveying device includes a plurality of substantially horizontal rollers, the axes of rotation of the rollers extending parallel to the advance direction of the potatoes, the rollers being rotatably mounted in a support frame and connected with a first driving device for rotating the rollers. The rollers are each independently additionally displaceable in parallel forwards and backwards in a substantially straight line.

12 Claims, 2 Drawing Sheets

U.S. PATENT DOCUMENTS

| | | | | | |
|---|---|---|---|---|---|
| 3,900,036 | A | | 8/1975 | Anderson | |
| 4,471,876 | A | * | 9/1984 | Stevenson et al. | 209/618 |
| 5,175,906 | A | * | 1/1993 | Holter | 15/3.16 |
| 5,449,911 | A | | 9/1995 | Crezee et al. | |
| 5,697,451 | A | * | 12/1997 | Nicholson | 171/133 |

FOREIGN PATENT DOCUMENTS

| | | | |
|---|---|---|---|
| EP | 0436244 | A1 | 7/1991 |
| EP | 1197307 | A1 | 4/2002 |
| FR | 2112736 | | 6/1972 |
| FR | 2185564 | | 1/1974 |
| FR | 2705593 | A1 | 12/1994 |

OTHER PUBLICATIONS

Communication In Cases For Which No Other Form Is Applicable (PCT/IB/345).
Corrected version of International Publication No. W02005/061130 A1.

* cited by examiner

APPARATUS FOR USE TO CHECK POTATOES OR SIMILAR ITEMS

TECHNICAL FIELD

The invention relates to an apparatus for use to check potatoes or similar items, said apparatus comprising a feeding device for advancing the potatoes in a plurality of rows, a conveying device adapted to receive the rows of potatoes from the feeding device and advancing them while maintaining the row structure, a camera with associated image processing means for recording and evaluating each individual potato on the conveying device, and a sorting device controlled by the image processing means, said sorting device being adapted to sort the potatoes.

BACKGROUND ART

A known apparatus automatically checks potatoes in such a manner that they are sorted according to different criteria, such as size, presence of different types of fungal diseases, damages etc. Unacceptable potatoes can be discarded thereby.

Until now, this procedure has been carried out using an apparatus, where the potatoes have been advanced in longitudinal direction by means of a feeding device in the form of a so-called vibration feeder to an endless belt, i.e. an endless conveyor belt with rotating rollers, the axes of said rollers extending transversely to the advance direction. Each of said rollers is provided with a plurality of circumferential grooves, the number of said grooves corresponding to the number of rows, said grooves being evenly spaced across each roller, seen in the axial direction thereof, and arranged with respect to each other from roller to roller in the advance direction of the conveyor belt in such a manner that they are mutually aligned so that the potatoes can be advanced in rows in the grooves, said potatoes being taken up individually by two adjacent rollers. In general, potatoes have an oblong shape and will therefore arrange themselves with their longitudinal axes extending parallel to the axes of the rollers, while being rotated around the longitudinal axes thereof by the rotation of the rollers. During the continuous movement of the endless belt the potatoes are conveyed to a position underneath a camera taking pictures of each individual potato in a conventionally known manner, said pictures being sent to a conventionally known image processing means recording the condition of the potato in question. At the end of the endless belt, there is a sorting device which may be controlled by the image processing means, if desired, so that here the potatoes are deposited in compartments depending on their condition.

As the potatoes are usually only rotated substantially around the longitudinal axes thereof, the ends of the potatoes have a tendency to remain hidden from the camera arranged above. This applies in particular to the outermost ends of potatoes in the outermost rows on the endless belt. Thus, there is a risk of potatoes that should have been discarded being approved for sale.

The described automatic sorting of potatoes has several advantages compared to manual sorting, as it has been found that using this method, fewer good potatoes are being discarded and fewer potatoes to be discarded are approved. This is due to the fact that manual sorting requires the operator in question to view each individual potato and make a quick judgement, which can be difficult to sustain over a longer period at an acceptable suitable speed.

DISCLOSURE OF INVENTION

The object of the invention is to provide an apparatus ensuring further improvements of the automatically functioning sorting.

According to the invention, this is obtained by the apparatus of the aforementioned type characterized in that the conveying device comprises a plurality of substantially horizontal rollers, the axes of rotation of said rollers extending parallel to the advance direction of the potatoes, that the rollers are rotatably mounted in a support frame and connected with a first driving device for rotating them, said rollers each independently being additionally displaceable in parallel forwards and backwards in a substantially straight line extending in a vertical plane, said plane comprising the axis of rotation of each roller, and inclining somewhat upwards, seen in the advance direction; and that the rollers are connected with a second driving device adapted to confer a reciprocating oscillating movement to each roller along said line.

As a result, the potatoes are both rotated around their longitudinal axes extending parallel to the advance direction of the conveying devices in a controlled manner and moved forward with a mutual distance so that the front end and subsequently the rear end are visible to the camera. This is due to the fact that the rollers convey a variable load onto the potatoes because of the oscillating movement thereof, while the potatoes generally remain in abutment with the rollers. The second driving device results in the rollers alternately being subjected to a forward and a backward force in a direction inclining upwards in the advance direction and forming an angle of approx. 10° with the horizontal axes of the rollers. Thus, an oscillating movement is conferred to the rollers in a substantially straight path in said direction. During the forward movement the rollers exert a force component directed against gravity on the potatoes, whereby the potatoes are pressed down against the rollers with increased force, resulting in the potatoes exerting an increased normal force on the rollers and thus increasing the ability of the rollers to rotate the potatoes. During the backward movement the rollers practically move in a direction away from the potatoes, whereby the potatoes exert a decreased normal force on the rollers, and the rollers may slip with respect to the potatoes. Thus, the rollers move backwards with respect to the potatoes, i.e. they are pulled away from underneath the potatoes, whereby the potatoes execute a relative forward movement with respect to the rollers. Using a suitable automatic setting of the movement amplitude of the rollers with respect to the rotational speed of the rollers it is possible for a camera to record all surfaces of an individual potato during its passage thereunder. Thus, the image processing means in question is able to perform a correct sorting of the potatoes, when they reach the sorting device, with greater accuracy.

As a result of avoiding the use of devices to ensure an individual advance to the conveying means, the apparatus is also comparatively simple.

According to the invention, the rollers may each independently be associated with second driving devices, thereby allowing for the possibility of balancing the conveying means by adjusting the oscillating driving devices to have mutually different phases, for example, so that they alternately are in opposite phase.

According to the invention, the rollers may be provided with a high-friction surface, such as longitudinal notches, thus securing that a rotational movement is conferred also to round and smooth potatoes or other similar items, such as apples, as a result of the rotation of the rollers.

BRIEF DESCRIPTION OF THE DRAWING

The invention is explained in detail below with reference to the drawing, in which.

BEST MODE FOR CARRYING OUT THE INVENTION

Figure 1:
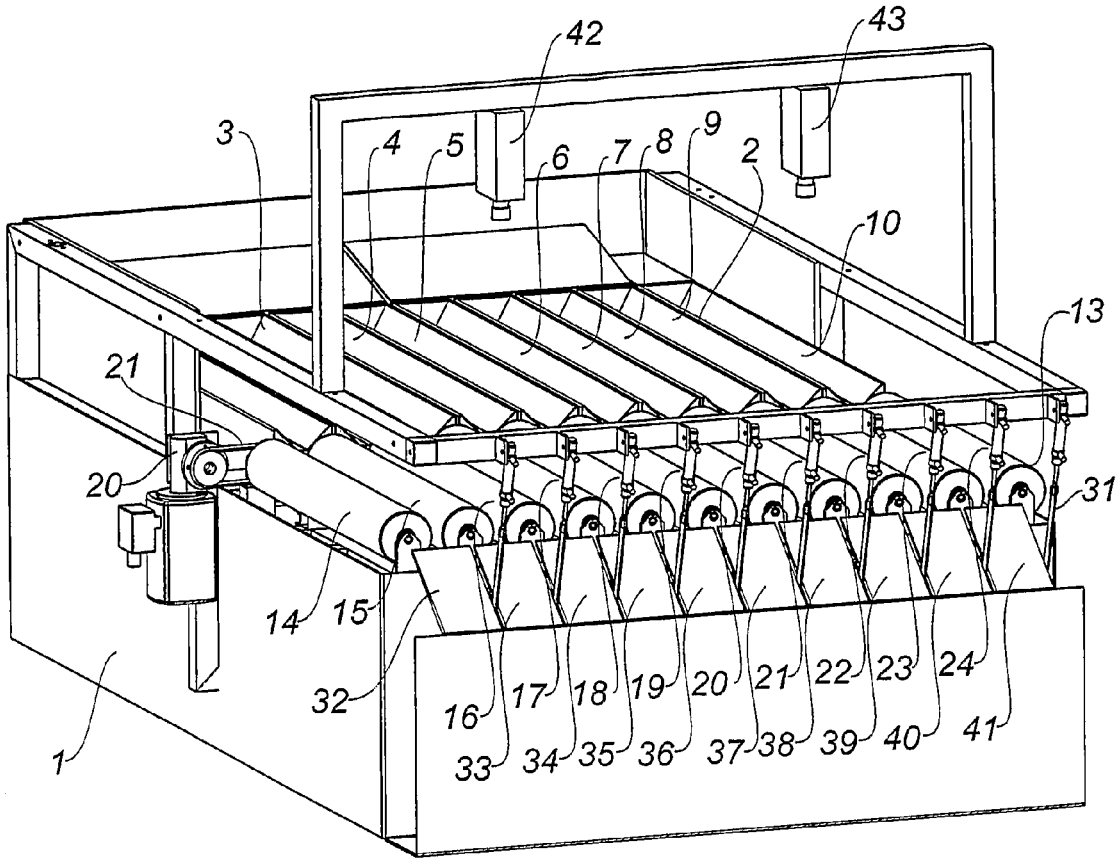
FIG. 1 shows a perspective view of an apparatus according to the invention.
Figure 2:
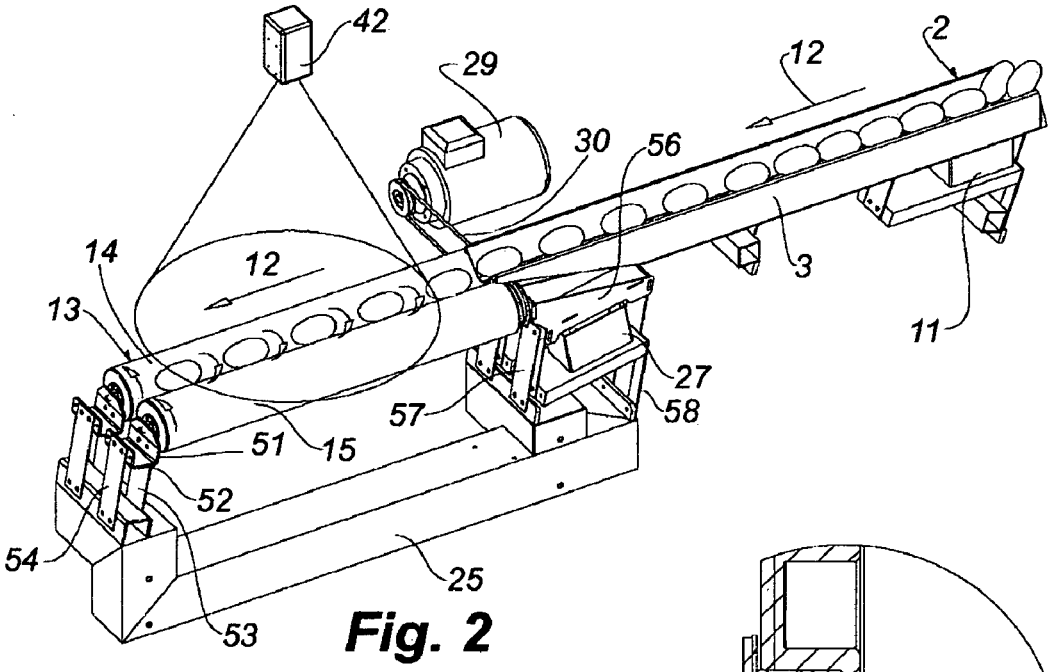
FIG. 2 shows a perspective view of a part of FIG. 1 during the handling of potatoes.
Figure 4:
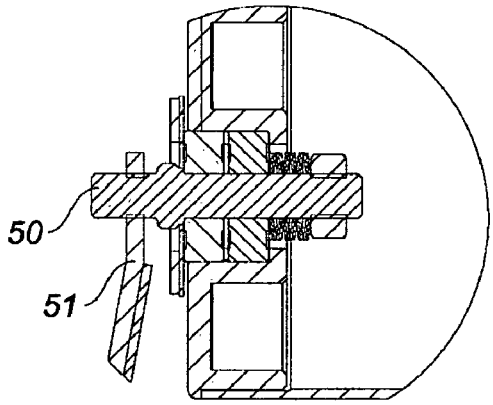
FIG. 4 shows detail A of FIG. 3 at the left-hand end of the roller on a greater scale.

FIG. 1 shows an apparatus for sorting potatoes. The apparatus comprises a frame 1, carrying a feeding device designated with the general reference numeral 2. The feeding device 2 comprises a plurality of channels 3-10, whereof only a single one is shown in FIG. 2 for the sake of clarity. As is apparent from FIG. 2, each channel 3 is carried by a driving device 11, said driving device being adapted in a conventionally known manner to confer a vibrating effect to the associated channels 3-10 in such a manner that potatoes arranged in the channel are advanced in an advance direction shown by means of an arrow 12 in FIG. 2. A conveyor, weighing devices and distributing devices (not shown) are associated with the feeding device 2, ensuring in a conventionally known manner that potatoes are delivered in an evenly distributed stream during the operation of the apparatus 1 in such a manner that the potatoes in the channels 3-10 are distributed in rows.

In front of the feeding device 2, seen in advance direction 12, there is a conveying device designated with the general reference numeral 13. The conveying device comprises a plurality of rollers 14-24. As is apparent from FIG. 2 showing two rollers 14, 15 associated with the channel 3, the rollers 14-24 are rotatably mounted in pairs on a support frame 25. The axes of rotation of the rollers 14-24 extends substantially horizontally, mutually parallel and parallel to the advance direction 12. The rollers 14-24 are arranged in such a manner with respect to the channels 3-10 that the channels 3-10 each independently can deliver rows of potatoes to a groove between two adjacent rollers 14-24. The rollers 14-24 are therefore arranged with a mutual distance in such a manner that the potatoes in question do not fall through the gap between the rollers.

Figure 3:
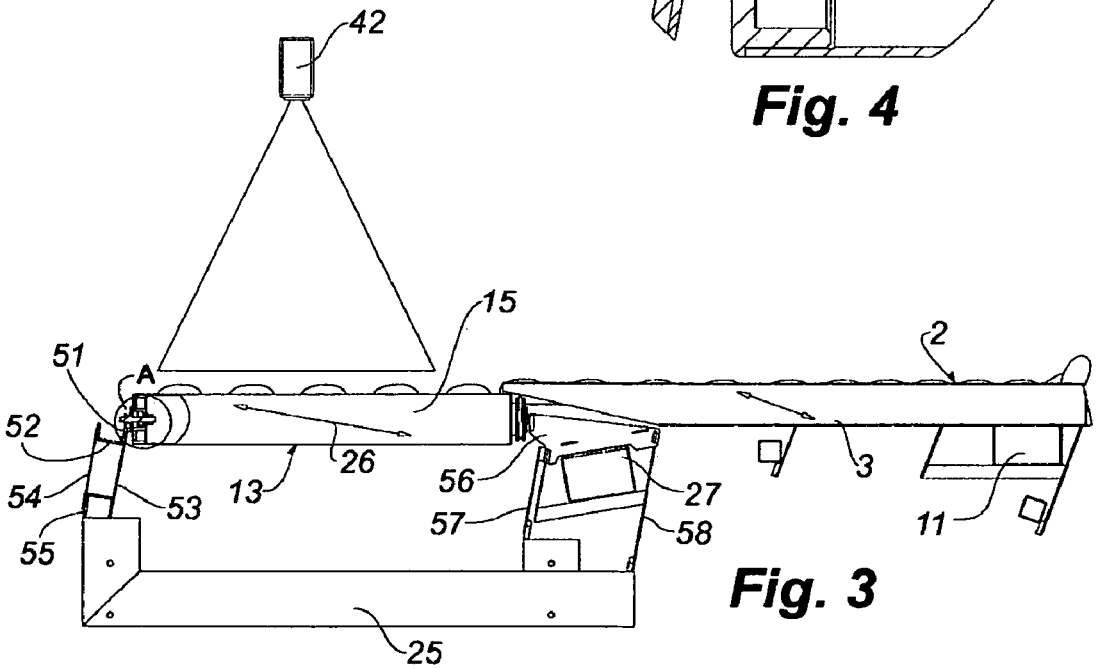
FIG. 3 shows a side view of the same, the left-hand end of the roller being shown in axial cross-section.

The rollers 14-24 are fastened to their support frames 25 using support means ensuring that each roller 14 and 15 is displaceable forwards and backwards in the direction shown by means of an arrow 26 in FIG. 3. Preferably, the direction has an inclination of 10.degree. with respect to the horizontal, said arrow being inclined upwards in the advance direction 12. At the front end of each individual roller, seen in the advance direction 12, a pivot 50 associated with the roller is fastened to one leg 51 of a U-profile 52. The U-profile 52 is connected to a U-profile 55 fastened to the frame 25 by means of two parallel spring plates 53 and 54. At the opposite end, the corresponding pivot is connected to a fixed frame part 56, the front and rear end of which being connected to the support frame 25 by means of spring plates 57 and 58, respectively. The spring plates 57 and 58 are also parallel to each other. In connection with each roller a driving device 27 is fastened at the bottom side of the frame part 56. The driving device 27 is adapted to affect the rollers in such a manner as to confer an oscillating reciprocating movement to them. Because of the displaceable suspension of the rollers by means of the spring plates 53, 54, 57 and 58, said movement occurs along a straight line 26.

Such a displaceable mounting of the rollers may be achieved in other conventionally Known manners, such as by means of guideways.

Accordingly, the driving devices 27 are adapted to subject the rollers 14-24 to such an effect load that the potatoes present between the rollers 14-24 are applied forces with a relatively large component in the forward direction parallel to the advance direction 12 and a small component in upward direction perpendicular to the plane of the rotational axes of the rollers 14-24. Immediately afterwards the rollers 14-24 are affected in opposite direction. This has been found to confer a forward movement to the potatoes which again has been found to ensure a mutual distance of said potatoes. Additionally, the rollers are connected to a driving device 29 by means of a belt drive designated with the reference numeral 30. The belt drive belongs to all rollers, which means that said rollers are rotated with the same rotational direction. Thus, a rotational movement is conferred to the potatoes between the rollers in such a manner that in general, they rotate around an axis extending parallel to the advance direction 12 while being advanced. The rotational movement of the potatoes is promoted, as described above, by means of the inclined forward and backward displacement of the rollers 14-24.

Following the conveying device 13 having rollers 14-24, there is a sorting device, designated with the general reference numeral 31. The sorting device 31 is of a conventionally known type and, in the embodiment illustrated in FIG. 1, consists of a flap 32-41 associated with each roller gap. By means of driving devices, the flaps 32-41 are each independently adapted to be adjustable in a desired position in such a manner that the potatoes leaving at the end of the rollers 14-24 are directed to a desired compartment (not shown). Additionally, above the conveying device 13, there are two cameras 42-43 arranged in a conventionally known manner, said cameras taking pictures of the advancing potatoes and allowing said pictures be processed in image processing means (not shown) adapted to control the sorting device 31 in such a manner that the individual flaps 32, 41 are brought into such a position that each individual potato is directed to a compartment in accordance with its condition.

Using the apparatus according to the invention, potatoes are advanced, as mentioned above, in rows by means of the individual channels 3-10, and subsequently advanced further in the gaps between the rollers 14-24. The oscillating reciprocating movement of the rollers in combination with the rotational movement thereof means that the potatoes rotate around an axis substantially extending parallel to the advance direction 12 while being advanced in said direction. Thereby, both the front and rear ends of the potatoes as well as the other sides thereof are brought within the exposure area of the cameras 42 and 43. Using a suitable setting of the advance velocity of the feeding device ensures a suitable distance between the potatoes on the rollers 14-24. Thereby, the advance velocity of the feeding device is usually adjusted in such a manner that it is slower than the advance velocity of the rollers 14-24.

Figure 5:
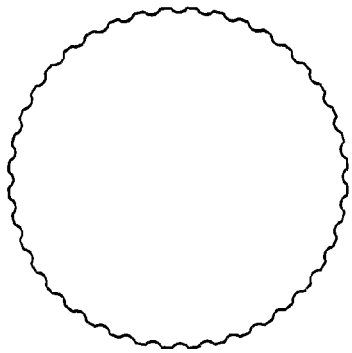
FIG. 5 shows a cross-section of an embodiment of a roller of the conveying device according to the invention.

In a preferred embodiment of the invention each individual roller has a diameter of 90 mm and a length of 630 mm and the number of rollers is eleven. The driving devices 27 associated with the respective rollers 14-24 are driven at a suitable setting in such manner that the total effect on the apparatus is balanced. For example, the oscillating driving devices 27 may alternate between being in phase opposition across the advance direction. To promote the effect on the potatoes in such a manner that they rotate around an axis parallel to the advance direction 12, the surfaces of the rollers may, as shown in FIG. 5, be provided with curved notches. It goes without saying, that the rollers may also be provided with another high-friction surface.

The apparatus according to the invention has been described in connection with the advancement of potatoes. However, it may also be used for other items, such as apples or carrots, having a surface to be evaluated by means of image processing means with associated cameras 42, 43.

A vibrator of a conventionally know type or another device, such as a device based on a crankshaft mechanism, may be used as oscillating driving device.

The invention has been described with reference to a preferred embodiment. However, many modifications can be carried out without thereby deviating from the scope of the invention. For example, the distance between the rollers 14-24 may be adjustable, and the number of rollers 14-24 with associated channels 3-10 may be different from the one illustrated and described.

All rollers 14-24 may also be arranged on a common support frame with a common oscillating driving device. The feeding device may be any other feeding device than the one described, if only it is adapted to convey potatoes or similar items forward in rows.

The invention claimed is:

1. Apparatus for use to check potatoes or similar items, said apparatus comprising:

a feeding device for advancing the potatoes in a plurality of rows;

a conveying device adapted to receive the rows of potatoes from the feeding device and advancing them while maintaining the row structure;

a camera with associated image processing means for recording and evaluating each individual potato on the conveying device; and a sorting device controlled by the image processing means, said sorting device being adapted to sort the potatoes, characterized in that the conveying device comprises a plurality of substantially horizontal rollers, the axes of rotation of said rollers extending parallel to the advance direction of the potatoes, that the rollers are rotatably mounted in a support frame and connected with a first driving device for rotating the rollers, said rollers each independently being additionally displaceable in parallel forwards and backwards in a substantially straight line extending in a vertical plane, said plane comprising the axis of rotation of each roller, and inclining upwards, seen in the advance direction and that the rollers are connected with a second driving device adapted to confer a reciprocating oscillating movement to each roller along said line.

2. Apparatus according to claim 1, wherein the rollers are each independently associated with second driving devices.

3. Apparatus according to claim 1, wherein the rollers are provided with a high-friction surface.

4. Apparatus according to claim 2, wherein the rollers are provided with a high-friction surface.

5. Apparatus according to claim 3, wherein the high-friction surface comprises longitudinal notches.

6. Apparatus according to claim 4, wherein the high-friction surface comprises longitudinal notches.

7. Apparatus for use to check potatoes or similar items, said apparatus comprising:

a feeding device for advancing the potatoes in a plurality of rows;

a conveying device adapted to receive the rows of potatoes from the feeding device and advancing them while maintaining the row structure;

at least one camera with associated image processor for recording and evaluating each individual potato on the conveying device; and a sorting device controlled by the image processor, said sorting device being adapted to sort the potatoes, wherein the conveying device comprises a plurality of substantially horizontal rollers, the axes of rotation of said rollers extending parallel to the advance direction of the potatoes, the rollers being rotatably mounted in a support frame and connected with a first driving device for rotating the rollers, said rollers each independently being additionally displaceable in parallel forwards and backwards in a substantially straight line extending in a vertical plane, said plane comprising the axis of rotation of each roller, and inclining upwards, seen in the advance direction, the rollers being connected with a second driving device adapted to confer a reciprocating oscillating movement to each roller along said line.

8. Apparatus according to claim 7, wherein the rollers are each independently associated with second driving devices.

9. Apparatus according to claim 7, wherein the rollers are provided with a high-friction surface.

10. Apparatus according to claim 8, wherein the rollers (14-24) are provided with a high-friction surface.

11. Apparatus according to claim 9, wherein the high-friction surface comprises longitudinal notches.

12. Apparatus according to claim 10, wherein the high-friction surface comprises longitudinal notches.

* * * * *